US009553351B2

(12) United States Patent
Baranski

(10) Patent No.: US 9,553,351 B2
(45) Date of Patent: Jan. 24, 2017

(54) GLAZING HAVING ANTENNAS AND A METHOD OF MANUFACTURING SAID GLAZING

(71) Applicant: PILKINGTON GROUP LIMITED, Nr. Ormskirk, Lancashire (GB)

(72) Inventor: Detlef Baranski, Marl (DE)

(73) Assignee: PILKINGTON GROUP LIMITED, Nr. Ormskirk, Lancashire (GB)

( * ) Notice: Subject to any disclaimer, the term of this patent is extended or adjusted under 35 U.S.C. 154(b) by 0 days.

(21) Appl. No.: 14/649,385

(22) PCT Filed: Dec. 2, 2013

(86) PCT No.: PCT/GB2013/053182
§ 371 (c)(1),
(2) Date: Jun. 3, 2015

(87) PCT Pub. No.: WO2014/087142
PCT Pub. Date: Jun. 12, 2014

(65) Prior Publication Data

US 2016/0013540 A1 Jan. 14, 2016

(30) Foreign Application Priority Data

Dec. 3, 2012 (GB) ..... 1221712.1

(51) Int. Cl.
*H01Q 1/12* (2006.01)
*H01Q 21/28* (2006.01)
*H01Q 1/50* (2006.01)

(52) U.S. Cl.
CPC ..... *H01Q 1/1285* (2013.01); *H01Q 1/1271* (2013.01); *H01Q 1/50* (2013.01); *H01Q 21/28* (2013.01)

(58) Field of Classification Search
CPC ..... H01Q 1/38; H01Q 1/128; H01Q 1/50
USPC ..... 343/700 MS, 850
See application file for complete search history.

(56) References Cited

U.S. PATENT DOCUMENTS

| | | | | |
|---|---|---|---|---|
| 5,099,250 | A | 3/1992 | Paulus et al. | |
| 5,568,156 | A | 10/1996 | Terashima et al. | |
| 8,077,100 | B2 | 12/2011 | Baranski | |
| 2003/0214580 | A1 * | 11/2003 | Iddan ..... | G02B 23/2476 348/81 |

(Continued)

FOREIGN PATENT DOCUMENTS

| | | | |
|---|---|---|---|
| GB | 2232331 | A | 12/1990 |
| JP | 2003-101318 | A | 4/2003 |

(Continued)

OTHER PUBLICATIONS

United Kingdom search report issued on Jun. 27, 2013, in corresponding United Kingdom Application No. 1221712.1.

(Continued)

*Primary Examiner* — Peguy Jean Pierre
(74) *Attorney, Agent, or Firm* — Buchanan Ingersoll & Rooney PC

(57) ABSTRACT

The invention is a new type of antenna connection which allows two or more antennas to be connected to an external circuit via a small surface contact. Surface contact size is reduced due to the use of coupling electrodes, at least portions of which are laid adjacent to and parallel with each other such that alternating current coupling occurs between them.

17 Claims, 12 Drawing Sheets

(56) References Cited

U.S. PATENT DOCUMENTS

| | | | | |
|---|---|---|---|---|
| 2006/0109179 | A1* | 5/2006 | Humpfer | H01Q 1/38 343/700 MS |
| 2010/0085261 | A1 | 4/2010 | Baranski | |
| 2012/0229345 | A1* | 9/2012 | Takaki | H01Q 1/2291 343/700 MS |

FOREIGN PATENT DOCUMENTS

| | | | |
|---|---|---|---|
| WO | 2008/058855 | A1 | 5/2008 |
| WO | 2011/049351 | A2 | 4/2011 |

OTHER PUBLICATIONS

International Search Report (PCT/ISA/210) mailed on Mar. 21, 2014, by the United Kingdom Patent Office as the International Searching Authority for International Application No. PCT/GB2013/053182.

Written Opinion (PCT/ISA/237) mailed on Mar. 21, 2014, by the United Kingdom Patent Office as the International Searching Authority for International Application No. PCT/GB2013/053182.

* cited by examiner

GLAZING HAVING ANTENNAS AND A METHOD OF MANUFACTURING SAID GLAZING

BACKGROUND OF THE INVENTION

The invention is concerned with a glazing having antennas and a means of electrical connection to an external circuit.

Antennas are incorporated into glazings in buildings and in vehicles.

The number of antennas in automotive glazing is increasing due to the demand for more communication systems in vehicles. The state of the art for communication systems in vehicles includes radio (AM, FM), digital audio broadcasting (DAB), television (TV), digital video broadcasting-terrestrial (DVB-t), telephone (GSM), navigation (GPS), WLAN, remote keyless entry (RKE), car-to-car communication and car-to-infrastructure communication (car2X) and paging systems.

A means of electrical connection to an external circuit may be provided by, for example, a surface contact, which may be linear or a two dimensional sheet, made of conductive material (metal, film or coating).

A coupling electrode may be positioned in direct current isolation from the surface contact such that only alternating current coupling occurs between the surface contact and the coupling electrode. The coupling electrode may be applied as a wire on the surface of, or embedded in, a layer of plastic material in laminated glass or a bi-layer glazing.

At least one antenna may be in direct current contact with the coupling electrode. The antenna may be arranged on a surface of the glazing U.S. Pat. No. 8,077,100 discloses a glazing comprising a surface contact, a coupling electrode and an antenna.

According to this prior art, improved performance of the connection between the surface contact and the antenna may be achieved for a particular frequency of alternating current when the coupling electrode length is approximately equal to an odd multiple of a quarter of the effective wavelength Lambda Effective in the glazing corresponding to frequency f, where f is the frequency of the signal received by the antenna.

U.S. Pat. No. 8,077,100 further discloses three embodiments having more than one antenna.

In the first embodiment, a broadband antenna is provided, comprising a surface contact and two antennas, one at each end of a shared coupling electrode. According to the prior art, optimum performance for frequencies f1 and f2 to be received by first and second antennas, occurs at specific lengths of coupling electrode. So a shared coupling electrode may lead to a compromise in performance.

In the second embodiment, two broadband antennas according to the first embodiment are placed side-by-side. So the surface contact is larger and more expensive and harder to conceal than in the first embodiment.

In the third embodiment, two coupling electrodes according to the first embodiment are placed at 90 degrees to each other and overlapping each other. The two coupling electrodes are in direct current isolation from each other and in alternating current isolation from each other. Due to the orientation at 90 degrees, the surface contact is larger, more expensive and harder to conceal than in the first embodiment. Furthermore the shape may protrude further from the edge of the glazing towards the centre, partly obscuring a vision area of the glazing.

It is desirable to find an improved means of electrical connection of external circuits to multiple antennas on a glazing having a surface contact, the surface contact being small and having a shape that does not obscure the vision area. The object of the present invention is to provide such an improved means of electrical connection.

SUMMARY OF THE INVENTION

According to the invention from a first aspect, a glazing comprises the features set out in claim 1 attached hereto.

Preferably, the average distance between first and second coupling electrodes is less than or equal to five millimeters. More preferably, the average distance between first and second coupling electrodes is less than or equal to two millimeters. Most preferably the average distance between first and second coupling electrodes is less than or equal to one millimeter.

The average distance between the first and second coupling electrodes is to be understood herein as the arithmetical average of distances over such portions of their lengths where the first and second coupling electrodes run adjacent to each other. Distance is measured between the adjacent portions of the first and second coupling electrodes.

Preferably the first and second coupling electrodes are linear. Preferably their length is more than ten times their width. The width is to be understood as the dimension perpendicular to the length and parallel to the plane of the glazing material.

Preferably the adjacent portions of the first and second coupling electrodes run substantially parallel.

Preferably the adjacent portions of the first and second coupling electrodes have at least one turn of the same shape. Preferably the adjacent portions of the first and second coupling electrodes have at least two turns of the same shape. Preferably the shape is a meander or "S"-shape, i.e. the shape comprises parallel portions connected at their ends to perpendicular portions. Alternatively the shape is a spiral.

The first and second coupling electrodes may be formed by a single piece of wire, such that the ends of the first and second coupling electrodes are connected to each other and the connection between first and second coupling electrodes is a loop.

The first and second coupling electrodes may consist of wire without insulation. Preferably, the first and second coupling electrodes consist of insulated wire.

Preferably the lengths of the adjacent portions of the first and second coupling electrodes overlapped by the surface contact 17 are selected to be approximately equal to odd multiples of a quarter of effective wavelengths in the glazing Lambda Effective1, Lambda Effective2 corresponding to resonant frequencies f1, f2, such that each coupling electrode and the surface contact form a transmission line acting as a band-pass filter, and signals received by first and second antennas in bandwidths centred on f1, f2 are transferred between each coupling electrode and the surface contact by low-impedance alternating current coupling. Bandwidth is defined as the range of frequencies in which the signal reception is sufficient for the required use.

In the case of a single ply of glazing material, for example toughened glass, it is preferable for the surface contact and the first and second coupling electrodes to be on the same surface of the ply of the glazing material and in direct current isolation from each other.

Preferably, the glazing further comprises a ply of plastic material covering a surface of the ply of glazing material. The first and second coupling electrodes may be in contact with a surface of the plastic material facing, or opposite, the ply of glazing material. A laminated glazing comprises a second ply of glazing material.

Preferably, the glazing further comprises an auxiliary conductor on a surface of the ply of glazing material opposite the surface contact. Use of such auxiliary conductor may assist in optimising the energy transfer between the coupling electrodes and the surface contact.

The width of the first and second coupling electrodes may be in the range 0.001 to 2 millimeters. The width means the dimension perpendicular to the length and parallel with the plane of the ply of glazing material. The average distance between the first and second coupling electrodes may be less than 10 millimeters.

According to the invention from a second aspect, a method of manufacturing an antenna glazing comprises the steps set out in claim 13.

Preferably, the first and second coupling electrodes are made from a single insulated wire with a loop therebetween, thereby to make the positioning process faster.

Preferably, after positioning the first and second coupling electrodes, the loop therebetween is cut. The effect of the cut is to make a zero phase difference between the signals from the first and second antennas.

Surprisingly, the inventor has shown that by arranging portions of the first and second coupling electrodes according to the claims such that the desired mutual coupling is provided, the technical effect of a smaller surface contact is achieved. Furthermore, by arranging portions of the first and second coupling electrodes to run adjacent to each other, so that alternating current coupling occurs between them, good performance for a desired frequency is achievable with a shorter length of antenna. Tests in an anechoic chamber demonstrate that the performance of multiple antennas provided with the inventive connection using mutually coupled coupling electrodes is acceptable for standards applicable to automotive glazing.

BRIEF DESCRIPTION OF THE DRAWINGS

The invention will now be described with reference to the attached figures.

DETAILED DESCRIPTION OF THE INVENTION

It should be noted that, while the invention is described as comprising two antennas, it may comprise more than two antennas. While the invention is described with regard to AM, FM, DAB and TV antennas on glass, this should not be regarded as limiting. The invention is applicable to other situations where electromagnetic energy is employed and transmission or reception of electromagnetic energy would be desirable.

The invention is applicable to glazings including plastic glazing, annealed, semi-toughened or toughened glass, laminated glass, coated glazing, wired glazing, bi-layer glazing (i.e. one layer of glass with one plastic layer) and combinations thereof.

Throughout the figures, identical components having the same purpose are labelled with the same numerals.

Figure 1A:
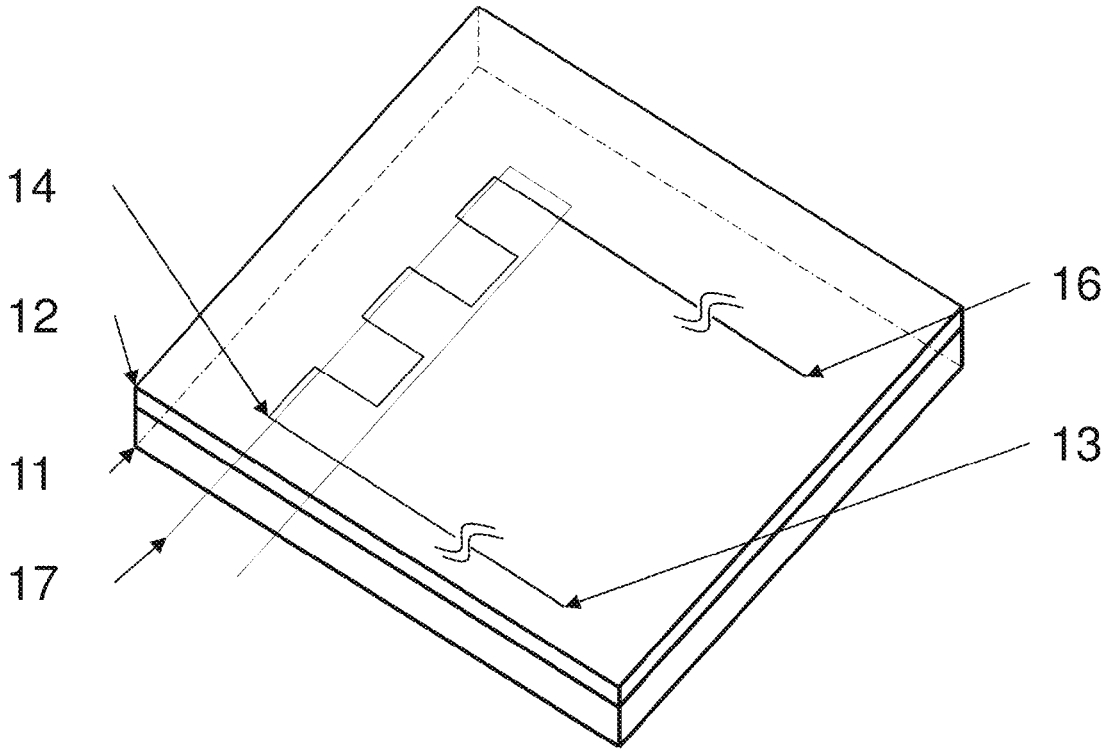
FIG. 1*a* is shows a typical glazing of the prior art with two antennas.

Referring to FIG. 1*a*, in the prior art U.S. Pat. No. 8,077,100 with two antennas, a transparent ply of glazing material 11 is bonded to a ply of plastic material 12. A first antenna 13, a coupling electrode 14 and a second antenna 16 are positioned on a surface of the ply of plastic material 12. A surface contact 17, formed by a linear conductor or a conductive sheet on a surface of the glazing material 11, is arranged so that alternating current coupling occurs with the coupling electrode 14. Alternating current coupling also referred to in the art as HF- or RF-coupling is intended herein to mean low impedance coupling at the frequencies for which the antennas are designed.

Figure 1B:
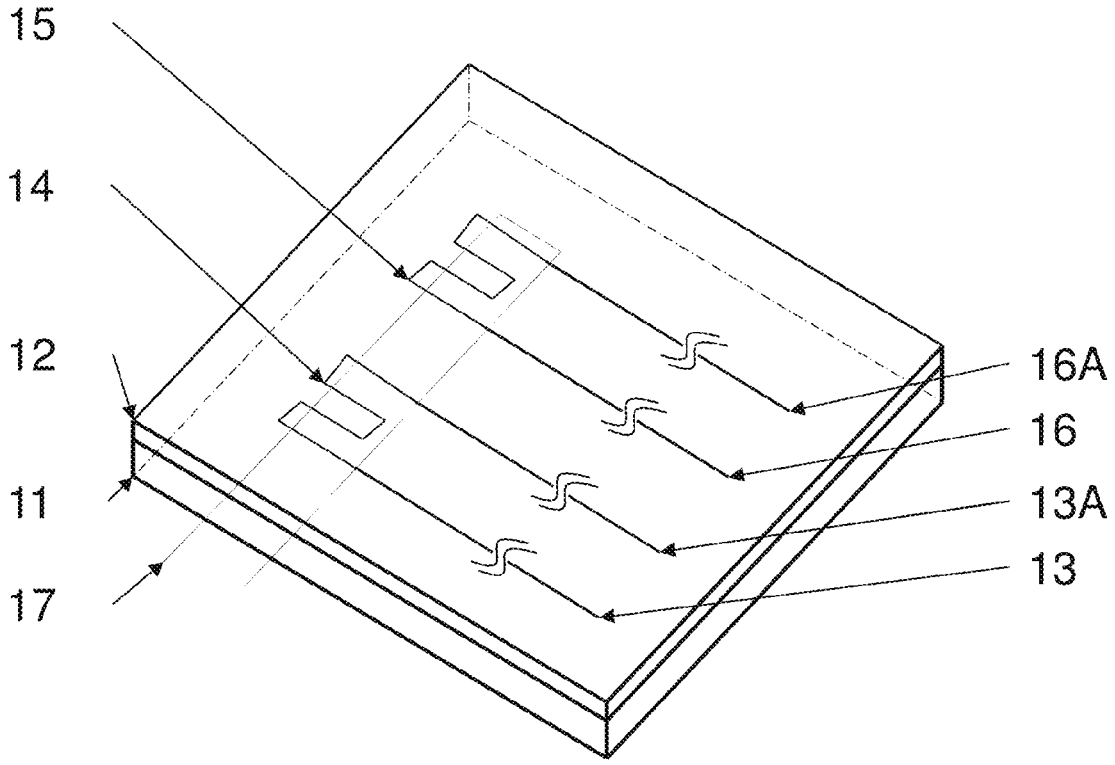
FIG. 1*b* shows a typical glazing of the prior art with four antennas.

Referring to FIG. 1*b*, in the prior art with four antennas, coupling electrodes 14 and 15 and antennas 13, 13A, 16 and 16A are positioned side by side on a surface of a ply of plastic material 12 bonded to a transparent ply of glazing material 11. A surface contact 17, formed by a linear conductor or a conductive sheet on a surface of the glazing material 11, is arranged so that alternating current coupling occurs between the surface contact 17 and each of the coupling electrodes 14, 15.

The first coupling electrode 14 and the second coupling electrode 15 have approximately the same shape, but the coupling electrodes 14, 15 are not configured to run adjacent to each other. To run adjacent is understood herein to mean neighbouring along the length. It is to be understood that in the invention "alternating current coupling occurring between adjacent portions of the first and second coupling electrodes" is meant to exclude configurations where such coupling occurs only indirectly, e.g. via a surface contact overlapping both coupling electrodes.

Figure 1C:
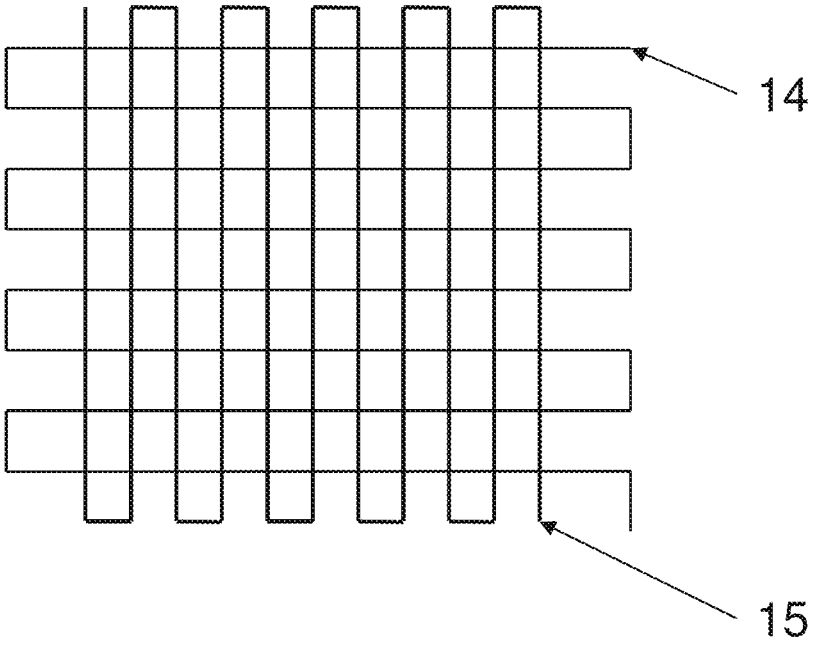
FIG. 1*c* shows coupling electrodes of the prior art arranged at 90 degrees to each other.

Referring to FIG. 1*c*, coupling electrodes 14 and 15 are arranged such that the linear conductors from which they are formed cross at right angles but are electrically isolated from each other, so that neither direct current coupling nor significant alternating current coupling occurs between them.

Figure 2A:
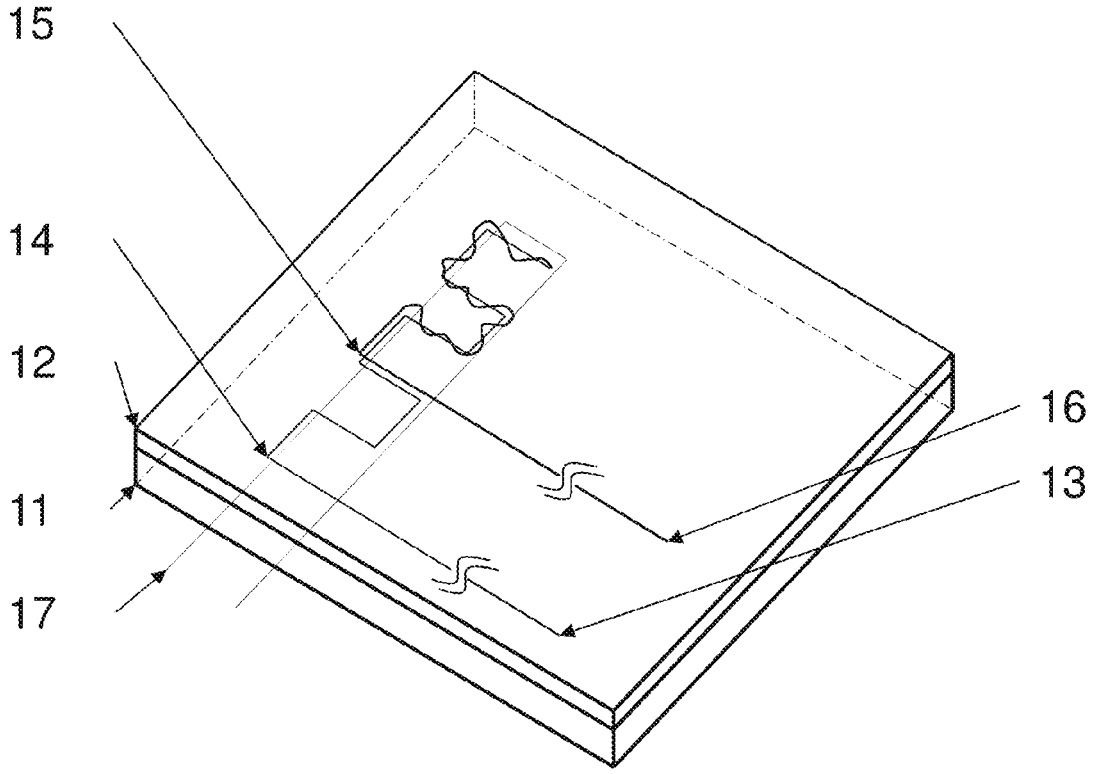
FIG. 2*a* shows a glazing according to the invention with two antennas.

Referring to FIG. 2*a*, according to an embodiment of the present invention with at least two antennas, a second coupling electrode 15 is runs adjacent and essentially parallel to a portion of a first coupling electrode 14. First and second coupling electrodes 14, 15 are thus arranged so that alternating current coupling occurs between their adjacent portions. Second coupling electrode 15 is partially wrinkled. First coupling electrode 14 consists of a plurality of straight lines in a meander shape. The first and second coupling electrodes 14, 15 may take any shape, so long as the desired mutual alternating current coupling is achieved. Surface contact 17 on a surface of the ply of glazing material 11 is arranged so that alternating current coupling occurs both with the first coupling electrode 14 and with the second coupling electrode 15. An advantage of the invention is that the size of the surface contact 17 is smaller than in the related prior art with two antennas as shown in FIG. 1*a*.

The average distance between adjacent portions of first and second coupling electrodes 14, 15 is less than or equal to 10 millimeters, preferably significantly less than 10 millimeters. The width of the first and second coupling electrodes 14, 15 is in the range 0.001 to 2 millimeters. The width means the dimension of the coupling electrode 14, 15 which is perpendicular to the length and parallel to the plane of the ply of glazing material 11.

Preferably, the length of the second coupling electrode 15 is between 5% and 100% of the length of the first coupling electrode 14, or vice-versa. For example, if the first coupling electrode 14 is designed to be used for an antenna working at 100 MHz and the second coupling electrode 15 is designed to be used for an antenna working at 200 MHz, then the length of the second coupling electrode 15 will be approximately 50% of the length of the first coupling electrode 14.

Preferably at least one of the conductive materials used for the coupling electrodes, antennas and/or surface contact 13-17 is wire. Examples of wire materials are copper, tungsten, gold, silver, aluminium, or an alloy thereof, nanowires, carbon nanotubes or a combination thereof. If the wire is not in direct current isolation from other conductors at all points along its length then insulation should be used at least at points where there is a risk of unwanted direct current contact. Such localised insulation may be achieved using insulating coating, which may also serve as adhesive.

More preferably, at least one of the conductive materials used for the coupling electrodes, antennas and/or surface contact 13-17 is insulated wire. Insulation allows the conductors to be arranged adjacent to each other but in direct current isolation, for example at cross-over points or if wires are parallel and in physical contact with each other. If two insulated wires contact each other directly then the average distance between them is twice the thickness of the insulation. The thickness of the insulation may be about 0.025 millimeters or less.

At least one of the conductive materials used for the coupling electrodes, antennas and/or surface contact 13-17 may be a conductive coating. Conductive coatings include, but are not limited to, silver prints applied by screen printing or transparent conductive coatings applied by sputtering or chemical vapour deposition. Insulation may be applied on a conductive coating by means of adhesive tape.

Alternatively, at least one of the conductive materials used for the coupling electrodes, antennas and/or surface contact 13-17 may be a conductive sheet. Conductive sheets include, but are not limited to, copper. The surface contact 17 is preferably made of copper sheet.

A first surface of the surface contact 17 may be in contact with a film of plastic material for structural support. A suitable plastic material is polyimide or polyethylene napthalate (PEN). A second surface of the surface contact 17 may be bonded to the surface of the glazing 11 by means of an adhesive. A suitable adhesive is 3M VHB double sided tape, available from 3M Center, St Paul, Minn., USA.

The ply of plastic material 12 may consist of, without limitation, polyvinyl butyral (PVB). Preferably the conductor materials used for the coupling electrodes and antennas 13-16 are insulated wire embedded in PVB.

Figure 2B:
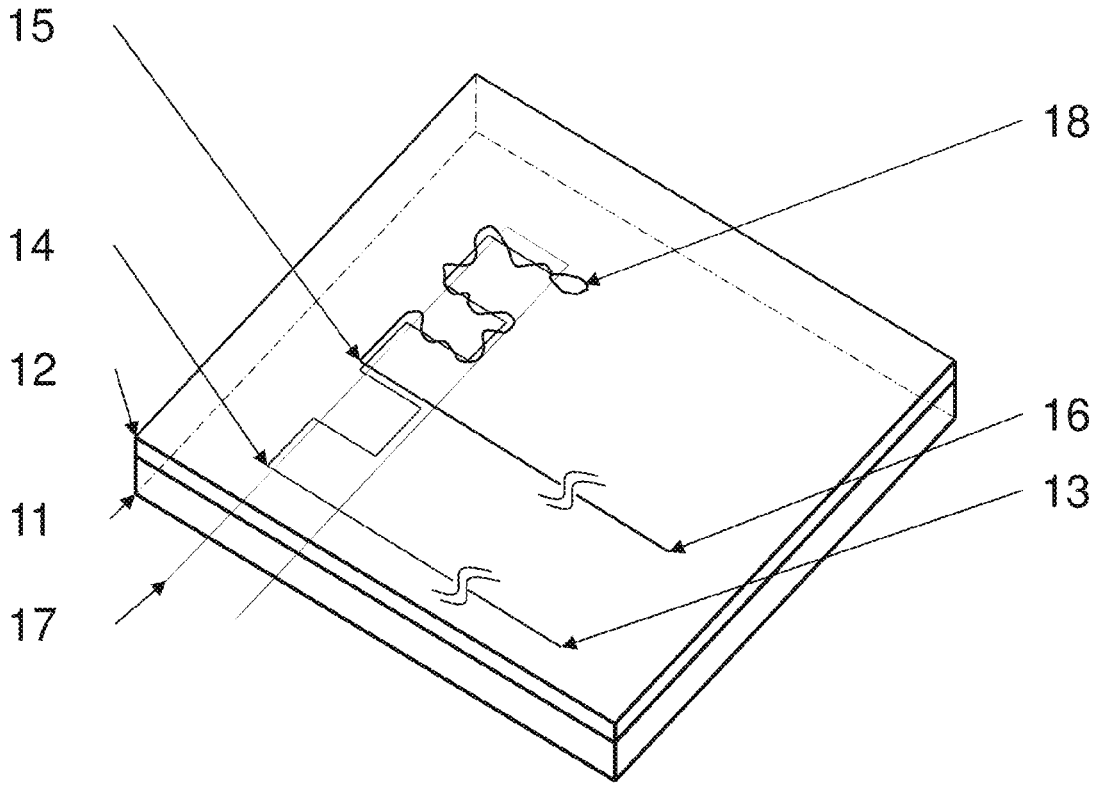
FIG. 2*b* shows a glazing as in FIG. 2*a* but with a loop connecting the coupling electrodes.

Referring to FIG. 2*b*, an alternative glazing according to the invention, the first coupling electrode 14 and the second coupling electrode 15 are connected by a loop 18.

Figure 3A:
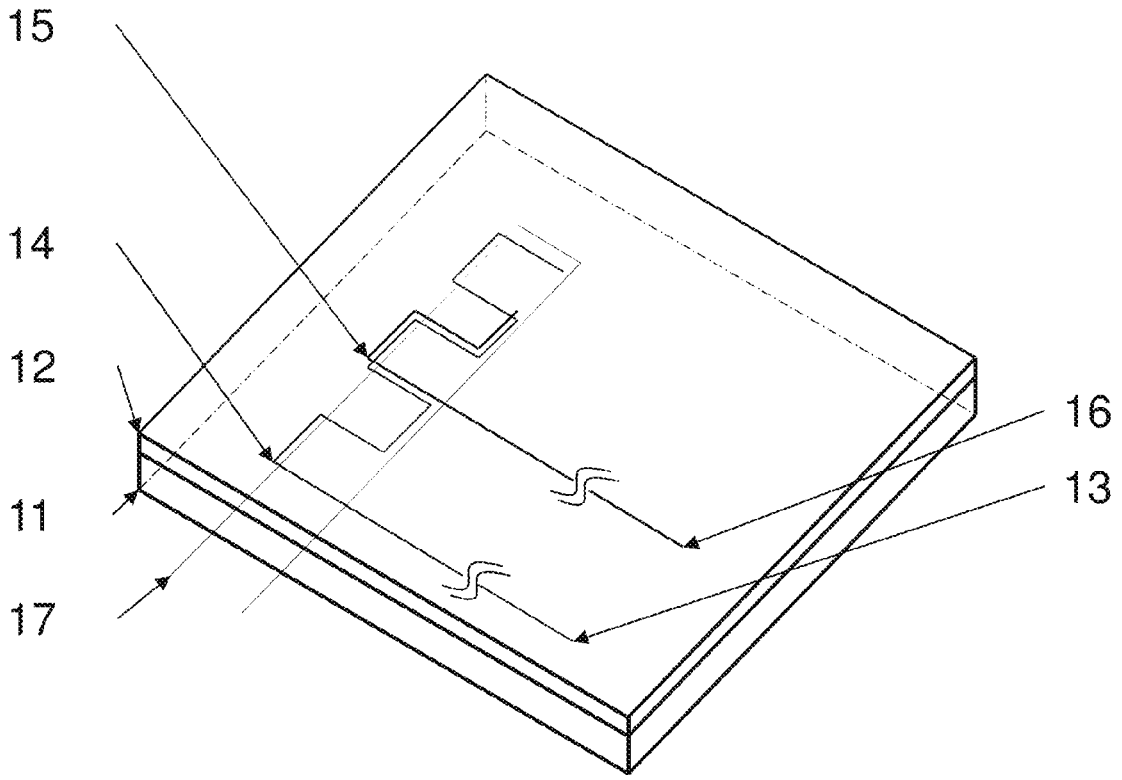
FIG. 3*a* shows a glazing according to the invention with two antennas and a surface contact.

Referring to FIG. 3*a*, an alternative glazing according to the invention, first and second coupling electrodes 14, 15 again run adjacent and substantially parallel along a portion of the first coupling electrode 14 but this time both coupling electrodes 14, 15 are formed in the shape of a plurality of straight lines. Both their shapes are meander shapes, as understood herein. The adjacent portions of the first and second coupling electrodes 14, 15 may also be described as collinear or piggy-backed.

In a preferred embodiment, the lengths of first and second coupling electrodes 14, 15 are selected to be approximately equal to odd multiples of a quarter of effective wavelengths in the glazing Lambda Effective1, Lambda Effective2 corresponding to resonant frequencies f1, f2. Each coupling electrode 14, 15 forms a transmission line acting as a band-pass filter for a selected frequency range with the surface contact 17, and signals received by first and second antennas 13, 16 in bandwidths centred on f1, f2 are transferred between coupling electrodes 14, 15 and surface contact 17 by alternating current coupling. The lengths of the coupling electrodes 14, 15 are understood herein to be the lengths of conductors in the area covered by the surface contact 17. Area is understood to mean the projection of the surface contact 17 in the plane of the coupling electrode 14.

Figure 3B:
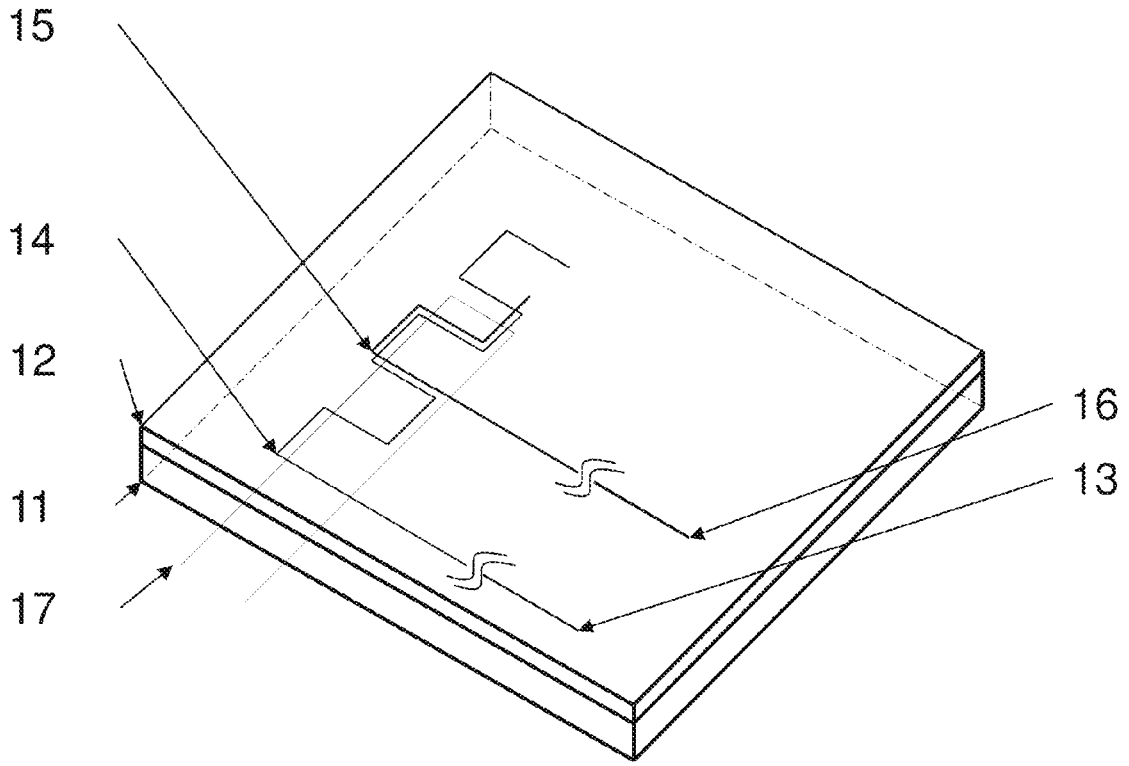
FIG. 3*b* shows a glazing as in FIG. 3*a* but with a shorter surface contact.

Referring to FIG. 3*b*, an alternative glazing according to the invention, the conductor comprising coupling electrode 14 extends beyond the area covered by the surface contact 17, so that the coupling electrode 14 is only the portion of the conductor covered by the surface contact 17. This is advantageous because the resonant frequency of the conductor comprising coupling electrode 14 may be increased by reducing the size of the surface contact 17. For example, a glazing having a conductor completely covered by the surface contact 17 may resonate at 70 MHz. The same glazing may resonate at 100 MHz if a surface contact 17 of reduced size is used. Therefore a manufacturer may make a standard antenna glazing without a surface contact 17 which is capable of receiving/transmitting a range of frequencies, and optimise performance for a particular frequency by applying a surface contact 17 of a suitable size.

Figure 4:
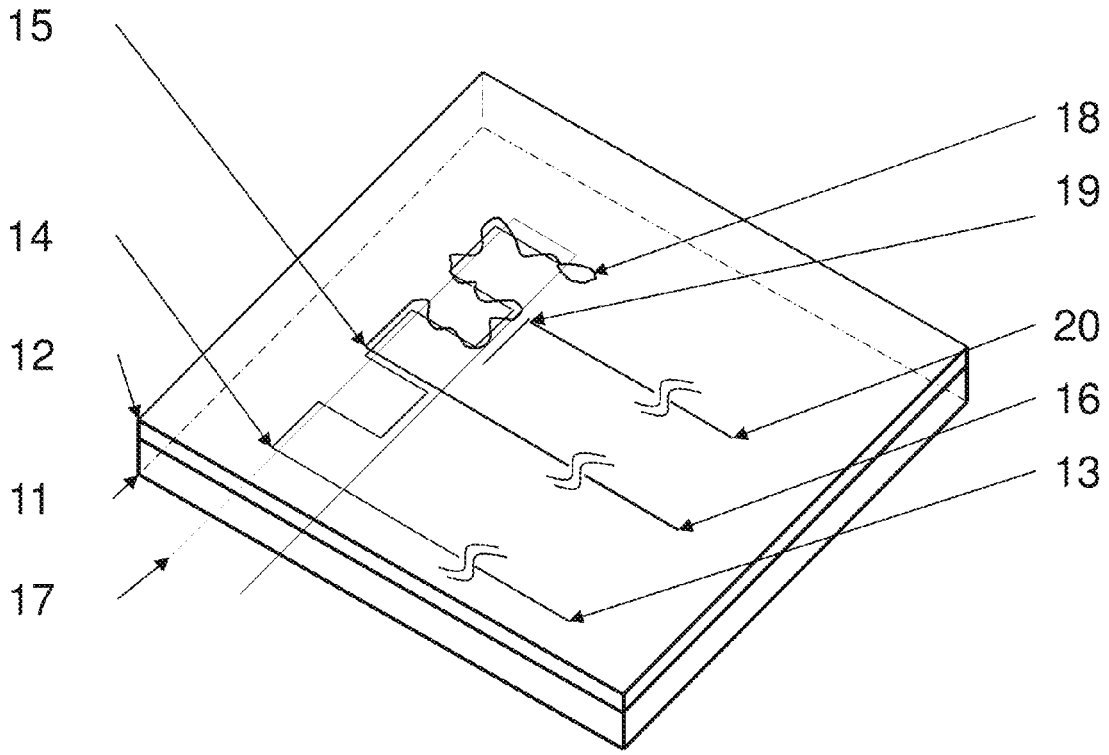
FIG. 4 shows a glazing according to the invention with three antennas.

FIG. 4 shows an alternative glazing according to the invention with three antennas. First, second and third coupling electrodes 14, 15 and 19 are arranged such that portions thereof run adjacent to each other so that alternating current coupling occurs between them and the average distance between the first coupling electrode 14 and each of second and third coupling electrodes 15, 19 is less than or equal to five millimeters.

The length of the second coupling electrode 15 that runs as a whole adjacent to a corresponding portion of the first coupling electrode 14 is approximately 75% of the length of the first coupling electrode 14. The length of the third coupling electrode 19 that runs as a whole adjacent to a corresponding portion of the first coupling electrode 14 is approximately 5% of the length of the first coupling electrode 14. A third antenna 20 that is direct current coupled to the third coupling electrode 19 is intended for TV signals, whereas first and second antennas 13, 16, which are direct current coupled to coupling electrodes 14, 15 respectively, are intended for FM.

In order to speed up the manufacturing process, one piece of conductive material is preferably used for first antenna 13, first coupling electrode 14, second coupling electrode 15 and second antenna 16. Loop 18 connects the first and second coupling electrodes 14, 15.

After applying the insulated wire material 13-16 to the ply of plastic material 12, loop 18 may be cut. The cut causes the phase difference between the signal from first antenna 13 and the signal from second antenna 16 to be zero. The option of cutting the loop provides a further parameter for optimising the reception performance of the antennas 13, 16.

Figure 5A:
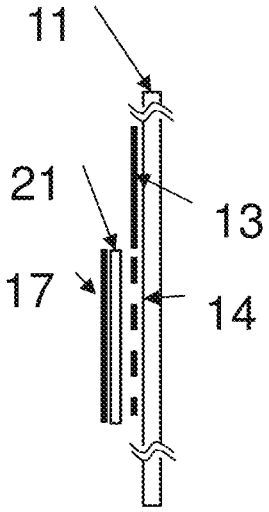
FIG. 5*a* shows a cross-section of a glazing according to the invention with an insulating adhesive.

FIG. 5*a* is a cross section of a ply of glazing material 11 with a first antenna 13 and a first coupling electrode 14 in direct current contact with each other. The first coupling electrode 14 is shown as a broken line to indicate its meander shape. A second antenna 16 and a second coupling electrode 15 are provided but are omitted for clarity. A surface contact 17 is bonded by adhesive 21 to the first coupling electrode 14 and (not shown) to the second coupling electrode 15. This arrangement is suitable for toughened glass in side windows, or rear windows or roof glazing of vehicles, in which the electrical conductors should all face the interior of the vehicle.

Figure 5B:
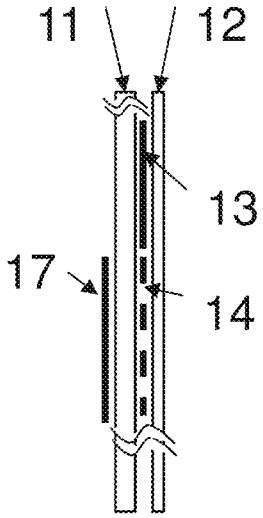
FIGS. 5*b* and 5*c* show cross-sections of glazings according to the invention as bi-layer or laminated glazing.

FIG. 5*b* is a cross section of a ply of glazing material 11 with a first antenna 13 and a first coupling electrode 14 in direct current contact with each other on a surface of the ply of glazing material 11. A second antenna 16 and a second coupling electrode 15 are provided but omitted for clarity. A surface contact 17 is on an opposite surface of the ply of glazing material 11. A ply of plastic material 12 is applied on top of the first antenna 13 and (not shown) on top of the second antenna 16. This arrangement is suitable for bi-layer glazings. Optionally a second ply of glazing material may be applied on top of the ply of plastic material 12 to form a laminated glass.

Figure 5C:
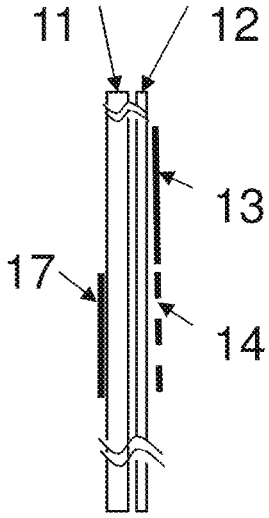

FIG. 5*c* is a cross section of a ply of glazing material 11 with a ply of plastic material 12 bonded to a surface thereof. A first antenna 13 and a first coupling electrode 14 are on top of the ply of plastic material 12. A second antenna 16 and second coupling electrode 15 are provided but omitted for clarity. A surface contact 17 is on an opposite surface of the ply of glazing material 11. This arrangement is suitable for bi-layer glazing. Optionally a second ply of glazing material (not shown) may be applied on top of the first antenna 13 and (not shown) on top of second antenna 16 to form a laminated glass.

Figure 5D:
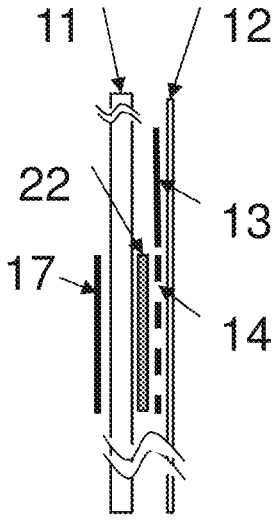
FIGS. 5*d* and 5*e* show cross-sections of glazings according to the invention with an auxiliary conductor.

FIG. 5*d* is a cross section of a ply of glazing material 11 with a surface contact 17 on a first surface of the ply of glazing material 11 and an auxiliary conductor 22 on an opposite surface thereof. A first antenna 13 and a first coupling electrode 14 are provided on the same surface of the ply of glazing material 11 as the auxiliary conductor 22. A layer of insulation, which may also serve as an adhesive, is provided between the auxiliary conductor 22 and the first coupling electrode 14, so that they are in direct current isolation, but is omitted for clarity. A second antenna 16 and a second coupling electrode 15 are also provided but omitted for clarity. A ply of plastic material 12 is applied on top of the first antenna 13 and (not shown) on top of the second antenna 16. This arrangement is suitable for bi-layer glazing. Optionally a second ply of glazing material may be applied on top of the ply of plastic material 12 to form a laminated glass.

Figure 5E:
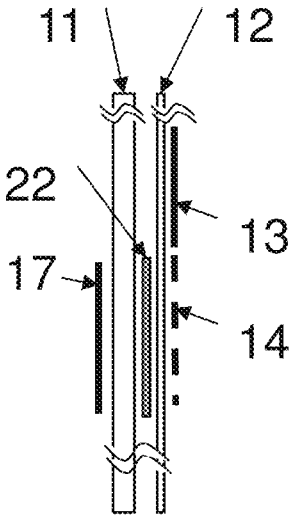

FIG. 5*e* is a cross section of a ply of glazing material 11 with a surface contact 17 on a first surface of the ply of glazing material 11 and an auxiliary conductor 22 on an opposite surface thereof. A ply of plastic material 12 is bonded to a surface of the ply of glazing material 11 and also serves to direct current insulate the auxiliary conductor 22. A first antenna 13 and a first coupling electrode 14 are embedded in the outer surface of the ply of plastic material 12. A second antenna 16 and a second coupling electrode 13 are omitted for clarity. This arrangement is suitable for bi-layer glazing. Optionally a second ply of glazing material may be applied on top of the ply of plastic material 12 to form a laminated glass.

The auxiliary conductor 22 in FIG. 5*d* and FIG. 5*e* has a shorter distance to the first coupling electrode 14 than the surface contact 17, so that the coupling capacitance between the first coupling electrode 14 and the surface contact 17 is increased. The performance of the inventive connection arrangement at low frequencies may thus be improved by provision of the auxiliary conductor 22. For example, a glazing according to the invention having an auxiliary conductor 22 may have better performance at 1 MHz in the AM medium wave band. Therefore by arranging the first and second coupling electrodes 14, 15, the surface contact 17 and the auxiliary conductor 22 so that the desired mutual alternating current coupling is provided, the size of the surface contact 17 is smaller than in the prior art U.S. Pat. No. 8,077,100.

Figure 6A:
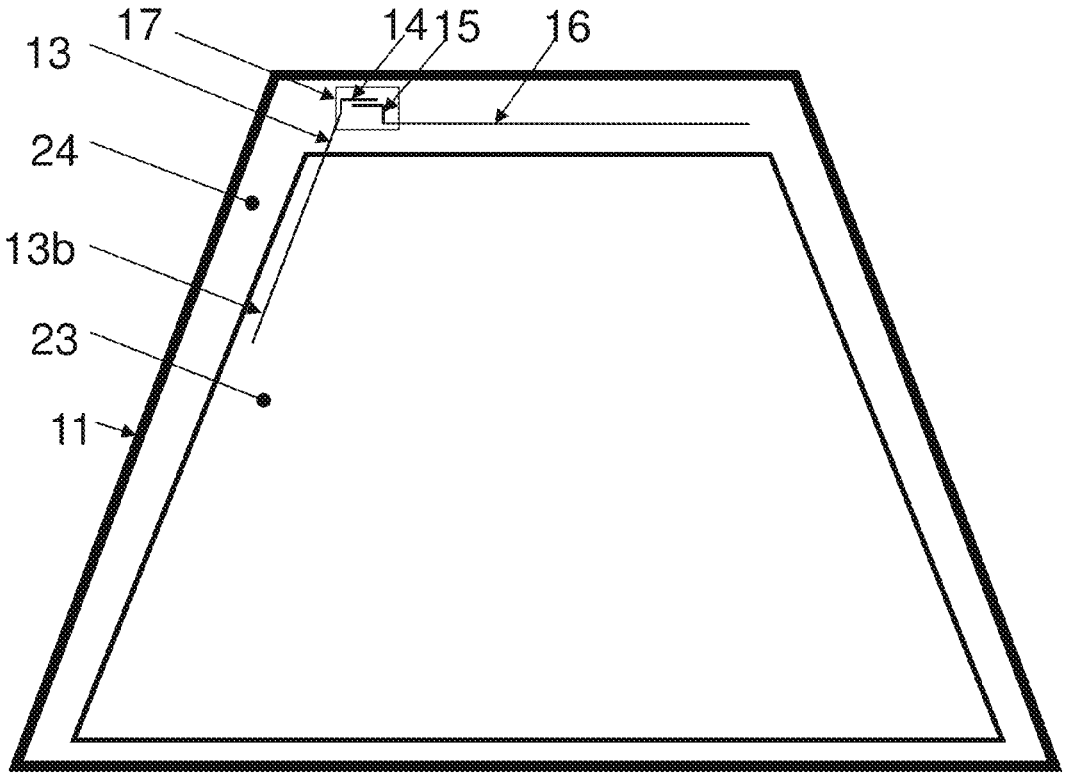
FIG. 6*a* shows a glazing according to the invention with slot and monopole antennas.

FIG. 6*a* is a glazing according to the invention with a slot antenna and a monopole antenna. The glazing comprises a ply of glazing material 11 and a conductive layer 23 applied to a surface of the ply of glazing material 11. The conductive layer 23 may be a conductive coating or a metallic film, partially transparent. Between the edge of the ply of glazing material 11 and the conductive layer 23 is a gap 24. A surface contact 17 is configured in the gap 24, and first and second coupling electrodes 14, 15 are positioned in direct current isolation from the surface contact 17, so that alternating current coupling but not direct current coupling occurs between the first and second coupling electrodes 14, 15 and the surface contact 17. A first antenna 13, having direct current connection to the first coupling electrode 14, is positioned such that an antenna portion 13*b* of the first antenna 13 is at least partially overlapped by the conductive layer 23, so that direct current or alternating current coupling occurs, and the antenna portion 13*b* acts as a feed for a slot antenna formed by the gap 24. A second antenna 16, having direct current connection to the second coupling electrode 15, is positioned in the gap 24 and forms a monopole antenna.

Figure 6B:
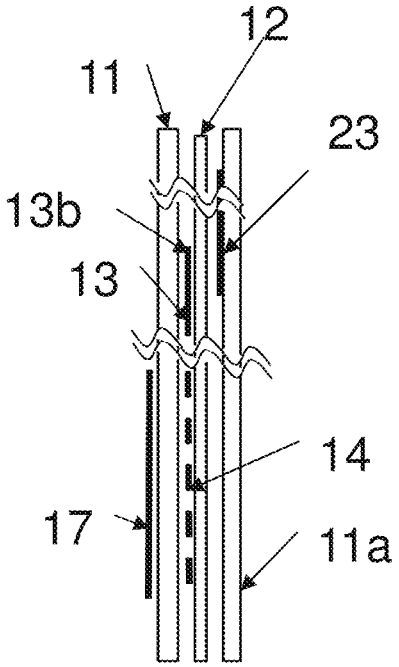
FIGS. 6*b* and 6*c* show embodiments of a glazing as in FIG. 6*a* but in cross-section.

FIG. 6*b* is a cross-section of part of the embodiment of the glazing according to FIG. 6*a* comprising a surface contact 17 on a ply of glazing material 11. A first coupling electrode 14 and a first antenna 13 in direct current connection therewith are positioned on a ply of plastic material 12, used as an interlayer for laminated glass, such that the first coupling electrode 14 is covered by the surface contact 17, on the opposite surface of the ply of glazing material 11. A second ply of glazing material 11*a*, having a conductive layer 23, is positioned such that the conductive layer 23 is at least partially overlaps an antenna portion 13*b* of the first antenna 13, such that alternating current coupling occurs between the antenna portion 13*b* and the conductive layer 23.

Figure 6C:
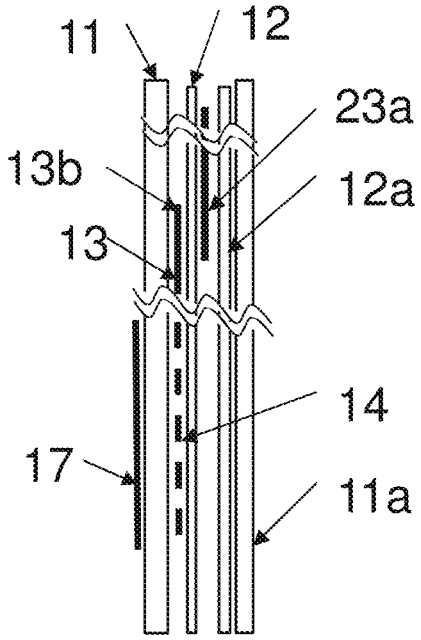

FIG. 6*c* is a cross-section of a glazing similar to that of FIG. 6*b* with the exception that the conductive layer 23 is omitted from the second ply of glazing material 11*a*, and the addition of a second ply of plastic material 12*a*, used as a second interlayer between a first ply of plastic material 12 and the second ply of glazing material 11*a*. The second ply of plastic material 12*a* has a conductive layer 23*a* thereupon, and is positioned such that the conductive layer 23*a* at least partially overlaps an antenna portion 13*b*, so that alternating current coupling occurs between them.

Figure 7A:
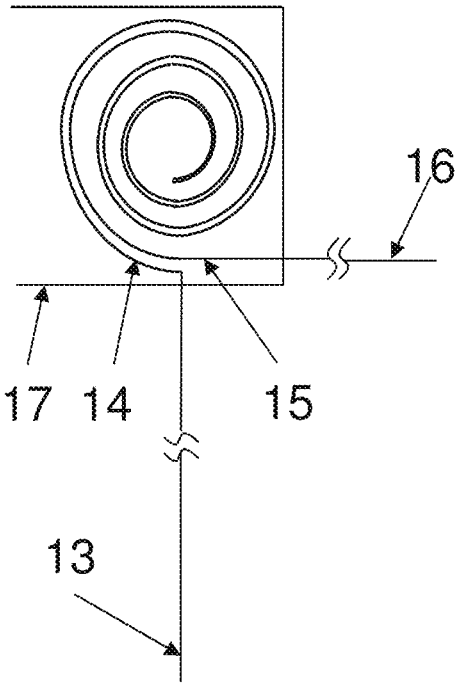
FIGS. 7*a* and 7*b* show parts of a glazing according to the invention, the coupling electrodes having a spiral shape.
Figure 7B:
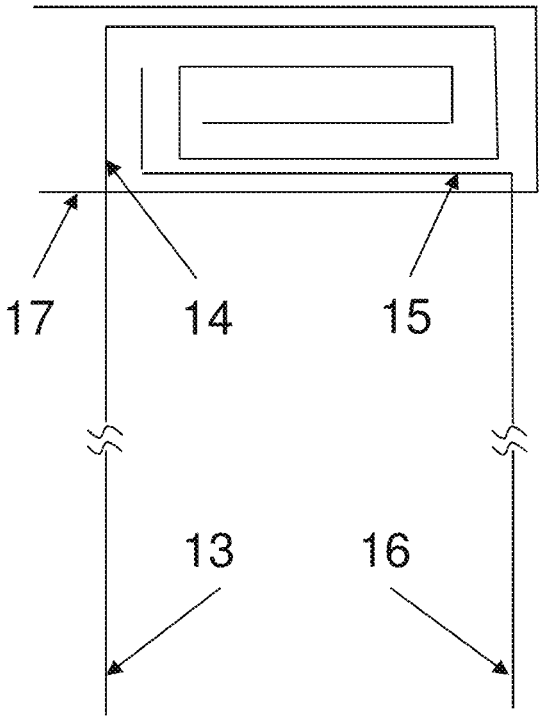

FIGS. 7*a* and 7*b* show the essential elements of further embodiments of the invention wherein first and second coupling electrodes 14, 15 are spiral shaped rather than meander shaped as shown in the embodiments of FIGS. 3 to 6.

A calculation of optimum length of a coupling electrode will now be disclosed. An effective wavelength in a material depends on the dielectric constants and the dimensions of the dielectric materials nearby. In a region containing electrical conductors, such as a folded coupling region, additional factors apply, dependent on the shape of the coupling electrode and antiparallel current effects in adjacent sections of a folded coupling electrode having current flowing in opposite directions.

For example, a signal of frequency 100 MHz has a wavelength in free space of approximately 3 meters, so one quarter wavelength Lambda in free space is 0.75 meters. A particular coupling electrode 14 on a laminated glazing may have a shortening factor of about 0.6, due to the dielectric glazing materials, so one quarter of Lambda Effective is about 0.45 meters. The coupling electrode 14 is then formed in a meander shape comprising parallel portions and connecting portions between the parallel portions such that the total length of the coupling electrode 14 is about 0.45 meters.

EXAMPLE

A simulation of the prior art as a comparative example and a simulation of the invention will now be discussed.

In both simulations, first and second antennas 13, 16, connected respectively to first and second coupling electrodes 14, 15, were positioned on a glazing 11 according to the prior art U.S. Pat. No. 8,077,100.

The desired frequency for the first antenna 13 was for FM radio reception at 100 MHz, for which a quarter of a wavelength in free space is approximately 750 millimeters. The shortening factor for the glazing was 0.545 and therefore a quarter of a wavelength of Lambda Effective was 409 millimeters. The first coupling electrode 14 with meander shape comprised four parallel portions each 100 millimeters long, and three connecting portions between the parallel portions each 3 millimeters long, such that the total length of the first coupling electrode 14 was 409 millimeters.

The desired frequency for the second antenna 16 was for DAB reception at 190 MHz, for which a quarter of a wavelength in free space is approximately 395 millimeters. The shortening factor for the glazing was 0.529 and therefore a quarter of a wavelength of Lambda Effective was 209 millimeters. The second coupling electrode 15 with meander shape comprised four parallel portions each 50 millimeters long, and three connecting portions between the parallel portions each 3 millimeters long, such that the total length of the second coupling electrode 15 was 209 millimeters.

In the comparative simulation a first coupling electrode 14 and a second coupling electrode 15 were arranged side by side, according to U.S. Pat. No. 8,077,100, second embodiment (see discussion above in the prior art description). A surface contact 17 was dimensioned as follows. The width of the surface contact 17, measured perpendicular to the adjacent edge of the ply of glazing material 11, was made equal to the sum of the lengths of the three connecting portions. Thus the width of the surface contact 17 was 9 millimeters. This width is narrower than a typical obscuration band for an automotive glazing. The length of the surface contact 17, measured parallel to the edge of the ply of glazing material 11, was made equal to the sum of the lengths of a parallel portion of the first coupling electrode 14, a parallel portion of the second coupling electrode 15 and the gap therebetween. Thus the length of the surface contact 17 was 160 millimeters, i.e. the length of first coupling electrode 14 was 100 millimeters, the length of second coupling electrode 15 was 50 millimeters and the length of the gap was 10 millimeters.

The comparative simulation calculated that the length of a second antenna 16 for optimum performance for DAB reception at 190 MHz was 240 millimeters.

In the corresponding simulation according to the invention, the first coupling electrode 14 and the second coupling electrode 15 were configured such that the second (shorter) coupling electrode 15 ran adjacent to a portion of the first coupling electrode 14 such that there was alternating current coupling therebetween, and the average distance between adjacent portions was less than 5 millimeters. The length of the surface contact 17 was 100 millimeters, i.e. the same length as a parallel portion of the first coupling electrode 14. The width of the surface contact 17 was again 9 millimeters.

The simulation according to the invention calculated that the length of the second antenna 16 for optimum performance for DAB reception at 190 MHz was 210 millimeters.

Therefore the invention reduced the length of the surface contact 17 from 160 millimeters to 100 millimeters, i.e. by 37%. Furthermore, the length of the second antenna 16 was reduced from 240 millimeters to 210 millimeters, i.e. by 12%.

The difference in the length of the second antenna 16 between the comparative simulation and the simulation according to the invention is evidence of a different effective wavelength Lambda Effective in the glazing in the area in which portions of the first and second coupling electrodes 14, 15 run adjacent to each other, due to the alternating current coupling which occurs therebetween.

What is claimed is:

1. A glazing, comprising:

a ply of glazing material;

a surface contact bonded to the ply of glazing material, for connection to an external circuit;

at least first and second coupling electrodes positioned in direct current isolation from the surface contact and configured so that alternating current coupling occurs between each coupling electrode and the surface contact;

at least first and second antennas, the first antenna having direct current connection to the first coupling electrode, and the second antenna having direct current connection to the second coupling electrode, wherein the first and second coupling electrodes each comprise at least one portion where the first and second coupling electrodes run adjacent to each other, so that alternating current coupling occurs therebetween.

2. A glazing according to claim 1, wherein the average distance between the adjacent portions of the first and second coupling electrodes is less than 5 mm.

3. A glazing according to claim 2, wherein at least one of, preferably both, the first and second coupling electrodes are linear.

4. A glazing according to claim 1, wherein the first and second coupling electrodes are substantially parallel.

5. A glazing according to claim 1, wherein the adjacent portions of the first and second coupling electrodes have the same meander shape or spiral shape.

6. A glazing according to claim 1, wherein the first and second coupling electrodes may be formed by a single piece of wire, such that the ends of the first and second coupling electrodes are connected to each other and the connection therebetween is a loop.

7. A glazing according to claim 1, wherein the first and second coupling electrodes are insulated wire.

8. A glazing according to claim 1, wherein the lengths of the adjacent portions of the first and second coupling electrodes overlapped by the surface contact are selected to be approximately equal to odd multiples of a quarter of effective wavelengths in the glazing Lambda Effective1, Lambda Effective2 corresponding to resonant frequencies f1, f2, such that each coupling electrode and the surface contact form a transmission line acting as a band-pass filter, and signals received by first and second antennas in bandwidths centred on frequencies f1, f2 are transferred between each coupling electrode and the surface contact by alternating current coupling.

9. A glazing according to claim 1, wherein the surface contact and the first and second coupling electrodes are on the same surface of the ply of glazing material and direct current insulated from each other.

10. A glazing according to claim 1, wherein a ply of plastic material is bonded to a surface of the ply of glazing material and the first and second coupling electrodes are in contact with a surface of the ply of plastic material.

11. A glazing according to claim 1, further comprising an auxiliary conductor on a surface of the ply of glazing material opposite the surface contact.

12. A glazing according to claim 1, wherein the width of the first coupling electrode and the width of the second coupling electrode are in the range 0.001 to 2 millimeters and the average distance between adjacent portions of the first and second coupling electrodes is less than 5 millimeters.

13. A glazing according to claim 1, wherein the average distance between the adjacent portions of the first and second coupling electrodes is less than 2 mm.

14. A glazing according to claim 1, wherein the average distance between the adjacent portions of the first and second coupling electrodes is less than 1 mm.

15. A method of manufacturing a glazing, comprising:

providing a ply of glazing material, bonding a surface contact on the ply of glazing material, arranging first and second coupling electrodes in direct current isolation from the surface contact such that alternating current coupling occurs between each of the first and second coupling electrodes and the surface contact, and configuring at least portions of the first and second coupling electrodes to run adjacent to each other so that alternating current coupling occurs occurs between the first and second coupling electrodes.

16. A method according to claim 15, wherein forming the first coupling electrode and second coupling electrode of a single insulated wire with a loop therebetween.

17. A method according to claim 16, further comprising cutting the loop connecting the first coupling electrode to the second coupling electrode.

* * * * *